US007455633B2

(12) United States Patent
Brown et al.

(10) Patent No.: US 7,455,633 B2
(45) Date of Patent: Nov. 25, 2008

(54) ABDOMINAL EXERCISER DEVICE

(75) Inventors: Wallace Brown, Chester, NJ (US); Robert W. Nelson, Rowlett, TX (US)

(73) Assignee: AB Coaster Holdings, LLC, Wilmington, DE (US)

( * ) Notice: Subject to any disclaimer, the term of this patent is extended or adjusted under 35 U.S.C. 154(b) by 54 days.

(21) Appl. No.: 11/607,745

(22) Filed: Nov. 30, 2006

(65) Prior Publication Data

US 2007/0149370 A1 Jun. 28, 2007

Related U.S. Application Data

(63) Continuation-in-part of application No. 11/030,420, filed on Jan. 5, 2005, now Pat. No. 7,232,404.

(60) Provisional application No. 60/741,104, filed on Nov. 30, 2005.

(51) Int. Cl.
*A63B 26/00* (2006.01)

(52) U.S. Cl. ..... 482/142; 482/140

(58) Field of Classification Search ..... 482/140, 482/72

See application file for complete search history.

(56) References Cited

U.S. PATENT DOCUMENTS

| | | | | |
|---|---|---|---|---|
| 567,915 | A | 9/1896 | McLarty | |
| 2,183,345 | A | 12/1939 | Brandon | 272/72 |
| 4,176,836 | A | 12/1979 | Coyle | 272/120 |
| 4,930,769 | A | 6/1990 | Nenoff | |
| 5,429,567 | A | 7/1995 | Gerschefske et al. | 482/70 |
| 5,518,483 | A | 5/1996 | Oswald | |
| 5,527,249 | A | 6/1996 | Harris | 482/96 |
| 5,620,403 | A | 4/1997 | Lundin | 482/96 |
| D397,745 | S | 9/1998 | Wu | D21/192 |
| D425,585 | S | 5/2000 | Wu | D21/676 |
| 6,183,397 | B1 | 2/2001 | Stearns | |
| 6,196,954 | B1 * | 3/2001 | Chen | 482/131 |
| 6,244,995 | B1 | 6/2001 | Prsala | 482/96 |
| 6,440,045 | B1 | 8/2002 | Gaston | |
| 6,634,996 | B2 | 10/2003 | Jacobsen | 482/96 |
| 7,232,404 | B2 * | 6/2007 | Nelson | 482/140 |
| 7,244,217 | B2 | 7/2007 | Rodgers, Jr. | |
| 2003/0022770 | A1 | 1/2003 | Lee | |
| 2004/0248713 | A1 | 12/2004 | Campanaro et al. | 482/123 |
| 2005/0085348 | A1 | 4/2005 | Kiefer et al. | 482/72 |
| 2006/0100070 | A1 | 5/2006 | Abdo | |
| 2006/0166798 | A1 | 7/2006 | Nelson | 482/140 |
| 2007/0021280 | A1 | 1/2007 | Tyree | |

(Continued)

OTHER PUBLICATIONS

AB Lounge, website description from www.fitnessquest.com, submitted with parent nonprovisional patent application, U.S. Appl. No. 11/030,420.

(Continued)

*Primary Examiner*—Lori Amerson
(74) *Attorney, Agent, or Firm*—Cisto & Thomas, LLP

(57) ABSTRACT

The abdominal exerciser of the present invention is an exercise device designed to work the abdominal and oblique muscle groups. The abdominal exerciser includes a leg support that can slide or roll along a track and an upper body support. The abdominal exerciser device is designed to simulate an abdominal exercise "crunch" motion when the knees are brought within proximity of the upper body support.

41 Claims, 10 Drawing Sheets

U.S. PATENT DOCUMENTS

| | | | |
|---|---|---|---|
| 2007/0184949 | A1 | 8/2007 | Weir et al. |
| 2008/0070765 | A1 | 3/2008 | Brown et al. |

OTHER PUBLICATIONS

AB Scissor, website description from "www.bodybyjake.com," submitted with parent nonprovisional patent application, U.S. Appl. No. 11/030,420.

AB Dolly2, website description from "www.fitnessquest.com," submitted with parent nonprovisional patent application, U.S. Appl. No. 11/030,420.

AB Slide[R], website review of the AB Slide[R] from "www.fitnessquest.com," submitted with parent nonprovisional patent application, U.S. Appl. No. 11/030,420.

AB Slider, website description from "www.wonderfulbuys.com," submitted with parent nonprovisional patent application, U.S. Appl. No. 11/030,420.

* cited by examiner

ABDOMINAL EXERCISER DEVICE

CROSS-REFERENCE TO RELATED APPLICATIONS

This document claims the priority through earlier filed U.S. Provisional Patent Application Ser. No. 60/741,104, filed Nov. 30, 2005, which is related to, and claims priority through earlier filed U.S. Continuation-in-Part application Ser. No. 11/030,420, filed on Jan. 5, 2005, now U.S. Pat. No. 7,232, 404, issued on Jun. 19, 2007, all of the subject matter of which are herein incorporated by this reference thereto in their entirety for all purposes.

BACKGROUND OF THE INVENTION

1. Technical Field

This invention relates to exercise machines for abdominal muscles and more, particularly to exercise machines in which the lower legs are supported by a leg support that utilizes a rolling, gliding, or sliding mechanism.

2. Description of Related Art

Traditional abdominal exercises, such as sit-ups are known to cause overload to the spine and neck and can easily cause injury when sitting up from a prone position to a sitting position. To correct this problem, many devices and exercises have been created in an attempt to develop and maintain the abdominal muscles. Unfortunately these devices and exercises often produce results which do not necessarily strengthen the abdominal muscles but strengthen the hip and thigh muscles attached to the lumbar spine area and to the rear of the pelvis and hip bones. When such muscles contract not only does the rectus muscle of the abdomen work with little effort but the other muscles rotate the pelvis forward thus creating the occurrence of increased lower back pain which contributes to poor mechanical alignment and undesirable upright posture of the exerciser.

For example, abdominal exercises that use arm slings and the person hanging from a bar are only beneficial to advanced athletes that are able to perform the exercise effectively. However, even when performed effectively, the back is extremely overloaded and the hip-flexors handle much of the load creating a risk of injury.

Also, lower abdominal exercises utilizing leg raises or reverse crunches where the knees are raised to the chest while the body is suspended vertically, supported only by arms or elbows, are strenuous on the lower back and offer minimal back support. These types of exercises are especially bad due to excessive strain on the back caused by lifting the knees to the chest. Furthermore, a significant number of people who do this type of abdominal exercise become injured with continued use.

Also, some exercise machines concentrate on cardio training with too little resistance thereby producing semi-effective strength training with very limited results. For example, exercise machines similar to the AB LOUNGE or AB SCISSOR provide more isolation than the above abdominal exercise but do not provide enough resistance because the exercise motions performed with these devices do not provide a resistance that is consistent with strength training.

In addition, exercise machines similar to the AB DOLLEY or AB SLIDE are effective for upper abdominal muscles and upper torso but not for lower abdominals. Also, exercises using these types of devices are difficult and dangerous for two reasons: first resistance is concentrated downward by gravity making isolation on the abdominal muscles impossible, as the entire upper torso, front and back muscles, and arms are needed to handle the load; and second, the user's back is forced into an ergonomically unfriendly angle with the upper body which is operating too low in conjunction with the lower body. Such a position is uncomfortable, awkward and can cause injury.

What is needed is an abdominal exerciser that will isolate the upper and lower abdominal muscles with true strength conditioning to change the shape of the overall abdomen muscle structure without compromising safety or support for the back. It would be beneficial if the apparatus could enable a user to execute the abdominal exercise in a biometrically neutral position, minimizing or eliminating back and neck strain. It would also be beneficial if the user could perform an upper abdominal crunch simultaneously with a controlled and supported reverse crunch. It would further be beneficial if the apparatus could allow the user to hold either the upper or lower crunch in a fully contracted "isometric" position while continuing with the opposite crunch rendering a dynamically concentrated isolation of the abdominal muscles.

SUMMARY OF THE INVENTION

The abdominal exerciser of the present invention is an exercise device designed to work the abdominal and oblique muscle groups. The abdominal exerciser includes a sled that is supported by and slides or rolls along at least one track. The upper body support is ergonomically positioned higher than the sled, and fixed to a cross bar supported by the track. The cross bar is designed to rotate forward to simulate a "crunch" motion when the knees are brought within proximity of the upper body support.

To perform the abdominal exercise, a user first positions the forearms on the upper body support and then positions the shins onto the sled. The user then slides the sled towards the upper body support by using the abdominal muscles to bring the knees close to the upper body support.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
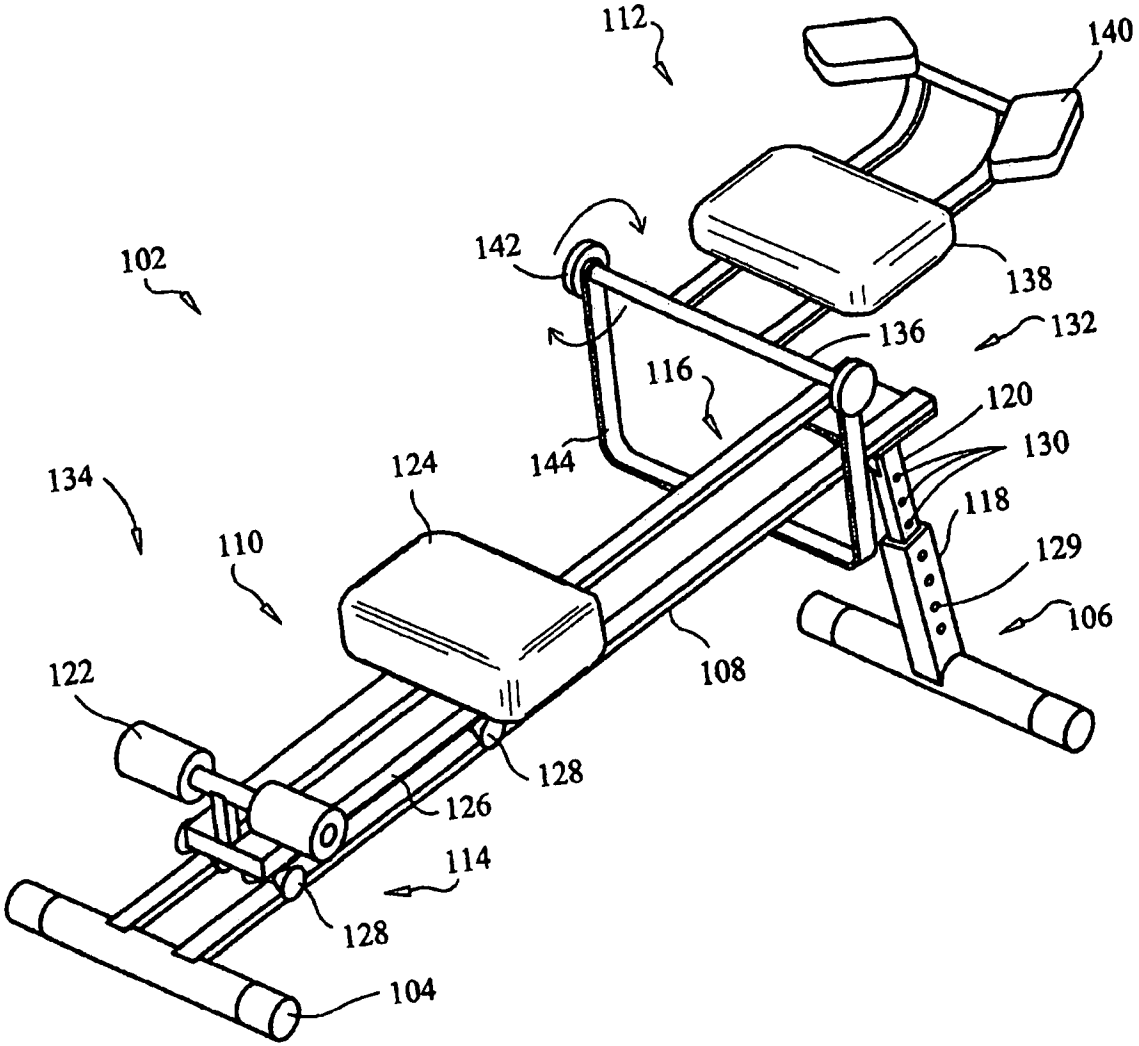
FIG. 1 is a perspective view of one embodiment of an abdominal exercise apparatus in accordance with the present invention.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

The abdominal exerciser of the present invention isolates the upper and lower abdominal muscles with true strength conditioning to change the shape of the overall abdomen muscle structure without compromising safety or support for the back. It also enables a user to execute the abdominal exercise in a biometrically neutral position, minimizing or eliminating back and neck strain. In one embodiment, the abdominal exerciser of the present invention allows a user to perform an upper abdominal crunch simultaneously with a controlled and supported reverse crunch. Also, it allows a user to hold either the upper or lower crunch in a fully contracted isometric position while continuing with the opposite crunch rendering a dynamically concentrated isolation of the abdominal muscles.

FIG. 1 shows one embodiment of abdominal exerciser 102. Abdominal exerciser 102 has a front portion 132, rear portion 134 and contains rear support 104, forward support 106, track 108, sled 110, and upper body support 112.

Rear support 104 rests on the ground and provides foundational support for abdominal exerciser 102. Rear support 104 may have a long tubular profile, a solid square or rectangular profile, or any other profile known in the art for use as support of a bench like structure similar to abdominal exerciser 102. Rear support 104 is attached to track 108.

Figure 5A:
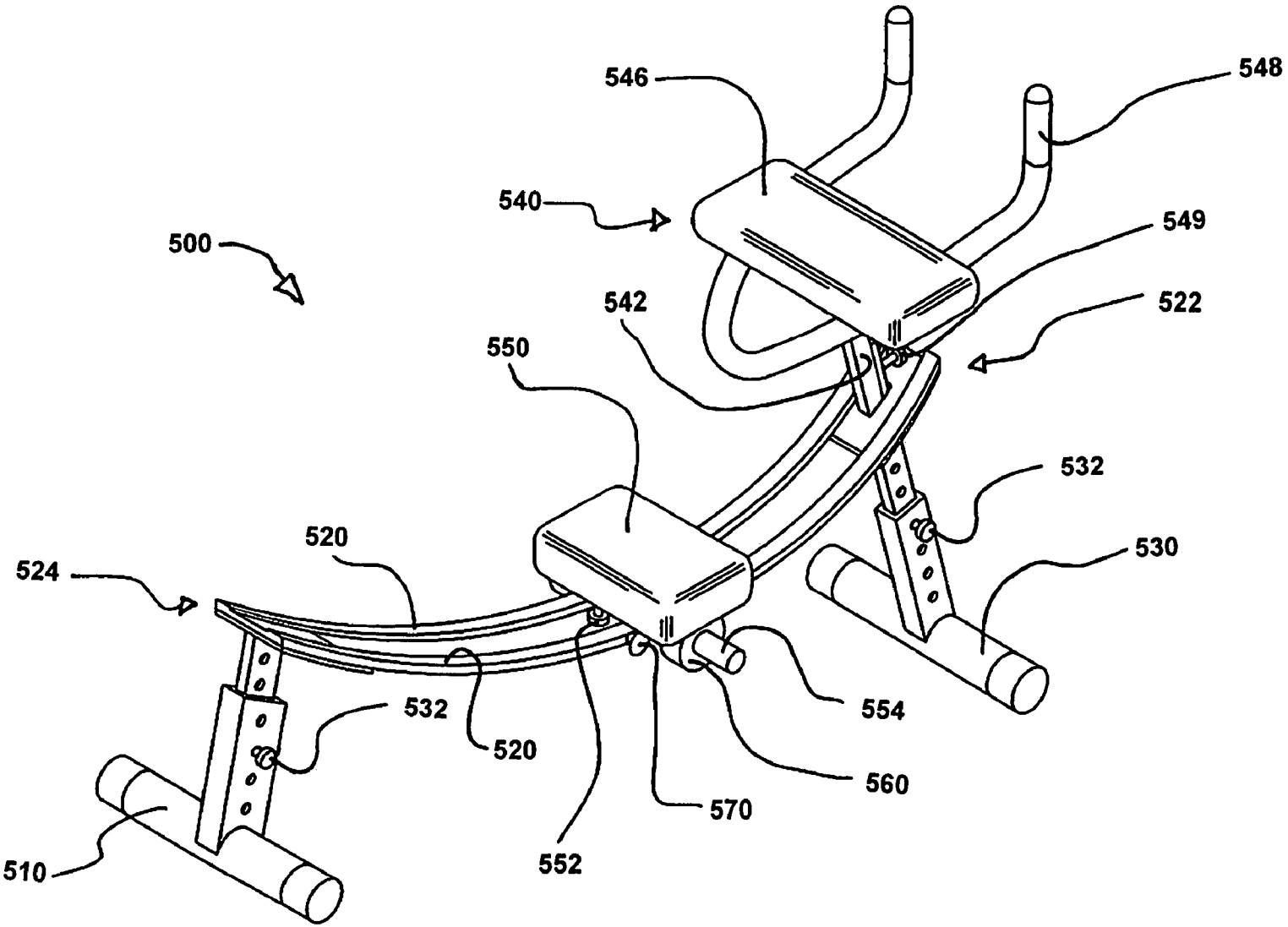
FIG. 5A is a perspective view of another embodiment in accordance with the present invention.
Figure 5B:
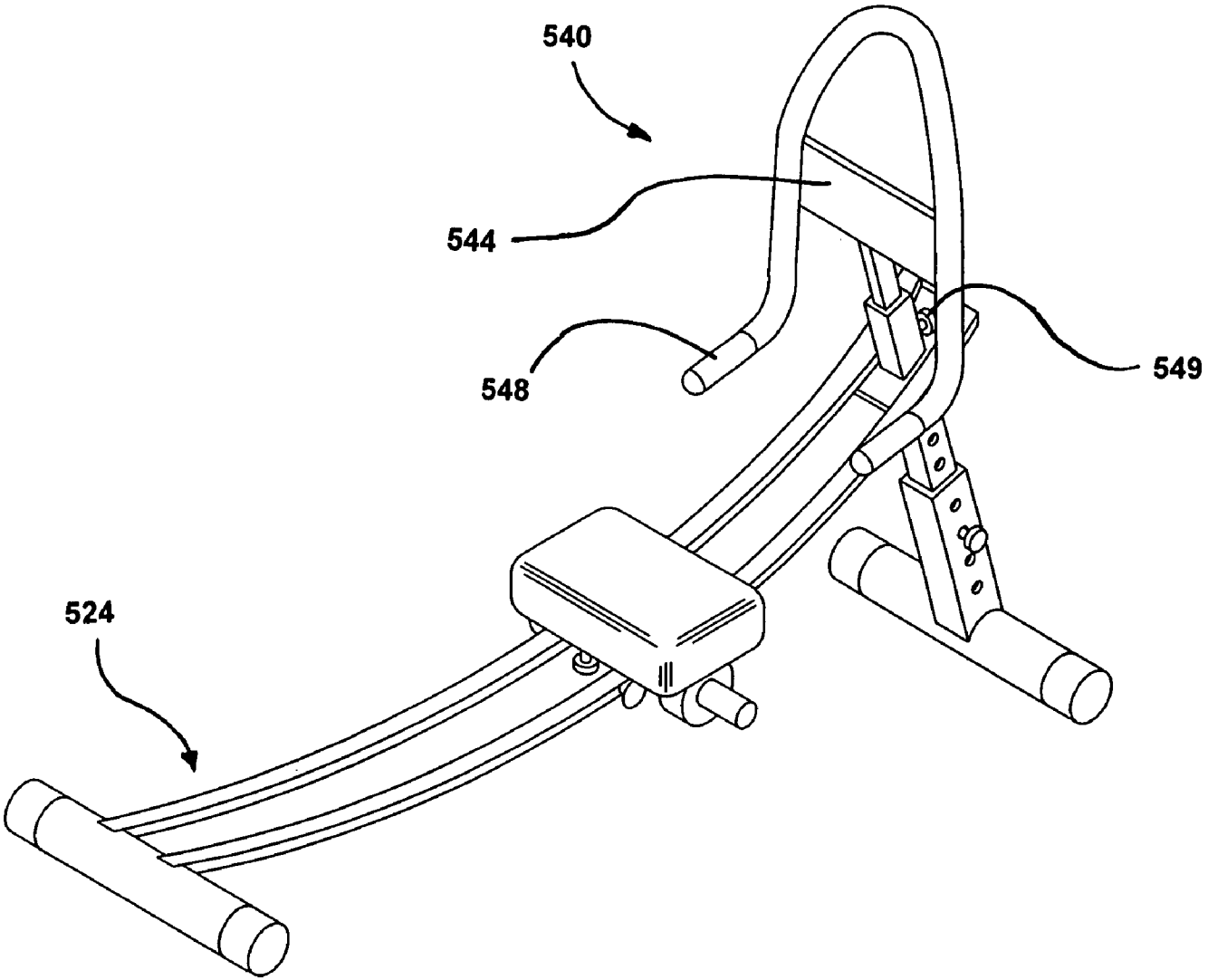
FIG. 5B is a perspective view of another embodiment in which the upper body support is rotated into a second position.

Track 108 can be made of metal, plastic with a metal or TEFLON® coating or some other material that has a relatively low coefficient of friction with the material used to make roller 128. In the preferred embodiment there are two tracks 108, however in other embodiments there may be only one track or, alternatively, more than two tracks. Track 108 extends from rear support 104 to forward support 106 and has a rear portion 114 proximate to rear support 104 and a forward portion 116 proximate to forward support 106. In another preferred embodiment, track 108 can be curved as shown in FIGS. 5A-5B. The curvature can be circular, ellipsoid, parabolic, or any other curved shape that advantageously affects the abdominal and oblique muscles.

In one embodiment the front foundation includes a telescopic extension to raise the height of one end of the track to a desired level of inclination. Forward support 106 elevates forward portion 132 of track 108 at least approximately 6 inches off the ground and contains hollow outer base 118 and adjustable top portion 120 and provides foundational support for abdominal exerciser 102. Base 118 may have a long tubular profile, a solid square or rectangular profile, or any other profile known in the art for use as support for a bench like structure similar to abdominal exerciser 102.

Adjustable top portion 120 is slidably mounted within outer base 118 in telescoping relation. By sliding the adjustable top portion 120 inwardly or outwardly relative to outer base 118, the overall length of forward support 106 can be selectively changed to vary the height of forward support 106. A locking means is provided for locking outer base 118 and adjustable top portion 120 in desired relative positions to create a desired length for forward support 106.

Preferably, the locking means includes at least one hole 129 in outer base 118 and a plurality of holes 130 in adjustable top portion 120 which can be selectively aligned with least one hole 129 in outer base 118. A pin member is constructed to be inserted in the aligned holes, thereby securely locking forward support 106 in the desired length. At least one hole 129 and holes 130 may be threaded holes, and the pin member may have cooperating threads to enable the pin to be threaded or screwed into the holes to secure forward support 106 at a desired length. Track 108 is secured to forward support 106 and forward support 106 elevates tracks 108 to a desired level, preferably at least approximately 6 inches above to provide an incline.

Sled 110 glides along track 108. Sled 110 contains sled base 126. Attached to sled base 126 are instep pad 122, knee pad or leg support 124, and roller 128. Roller 128 may be made of metal, plastic with a metal or TEFLON® coating or some other material that has a relatively low coefficient of friction on the material used to make track 108. In an alternate embodiment, roller 128 may be ball bearings, roller bearings or some other means which would allow sled 110 to travel along track 108 with a relatively low coefficient of friction.

Instep pad 122 is made of dense foam, rubber, or some other similar material. The purpose of instep pad 122 is to elevate the feet to avoid interfering with the movement of the sled. Other means may be used to elevate the feet such as a wedge or the feet may not be elevated at all.

In one embodiment, knee pad 124 can pivot up to approximately 45 degrees to the right or left of a plane vertical to the center of sled 110. By pivoting knee pad 124 the oblique muscles can be effectively exercised.

Sled 110 can travel the entire length of track 108 but preferably travels to the approximate area of upper body support 112.

Upper body support 112 is attached to front portion 132 of abdominal exerciser 102 and comprises at least one handle 548. In another embodiment, the upper body support 112 comprises an elevation bar 144 attached to the track 108 and at least one handle 548 attached to the elevation bar 144. In another embodiment the upper body support can comprise an elevation bar 144, a cross bar 136, an arm pad or arm support 138, and a chest pad or chest support 140. Elevation bar 144 is attached to track 108 such that sled 110 can travel past elevation bar 144. In an alternate embodiment, elevation bar 144 is attached to track 108 such that sled 110 cannot travel past elevation bar 144. In addition, elevation bar 144 may be attached to forward support 106. Cross bar 136 is pivotally attached to elevation bar 144 and suspend approximately 12 to 48 inches above track 108.

Cross bar 136 is pivotally attached to elevation bars such that the amount of torque required to rotate cross bar 136 can be adjusted, preferably by tension control member 142. Tension control member 142 controls the amount of resistance required to rotate cross bar 136 and can be set such that cross bar 136 may be locked in any rotational position especially one where arm pad 138 has been rotated towards track 108.

In an alternate embodiment the handles 548 can be pivotally attached to the elevation bar 144 and suspended approximately 12 to approximately 48 inches above the track 108.

Arm pad or arm support 138 is attached to cross bar 136, has a general rectangular or square profile, and is made of dense foam or some other similar material. Arm pad 138 provides support for the arms during use. Chest pad 140 is attached to arm pad 138 and elevated approximately 1 to 36 inches above arm pad 138. Chest pad 140 has a general cylindrical, rectangular, or square profile and is made of dense foam or some other similar material. Chest pad 140 provides support for the chest during use. In an alternate embodiment, a head support may be used to support the head.

In addition, shoulder pads may be used in conjunction with or to replace chest pad 140. Other means to support the upper body of the user would be apparent to one skilled in the art.

Figure 2:
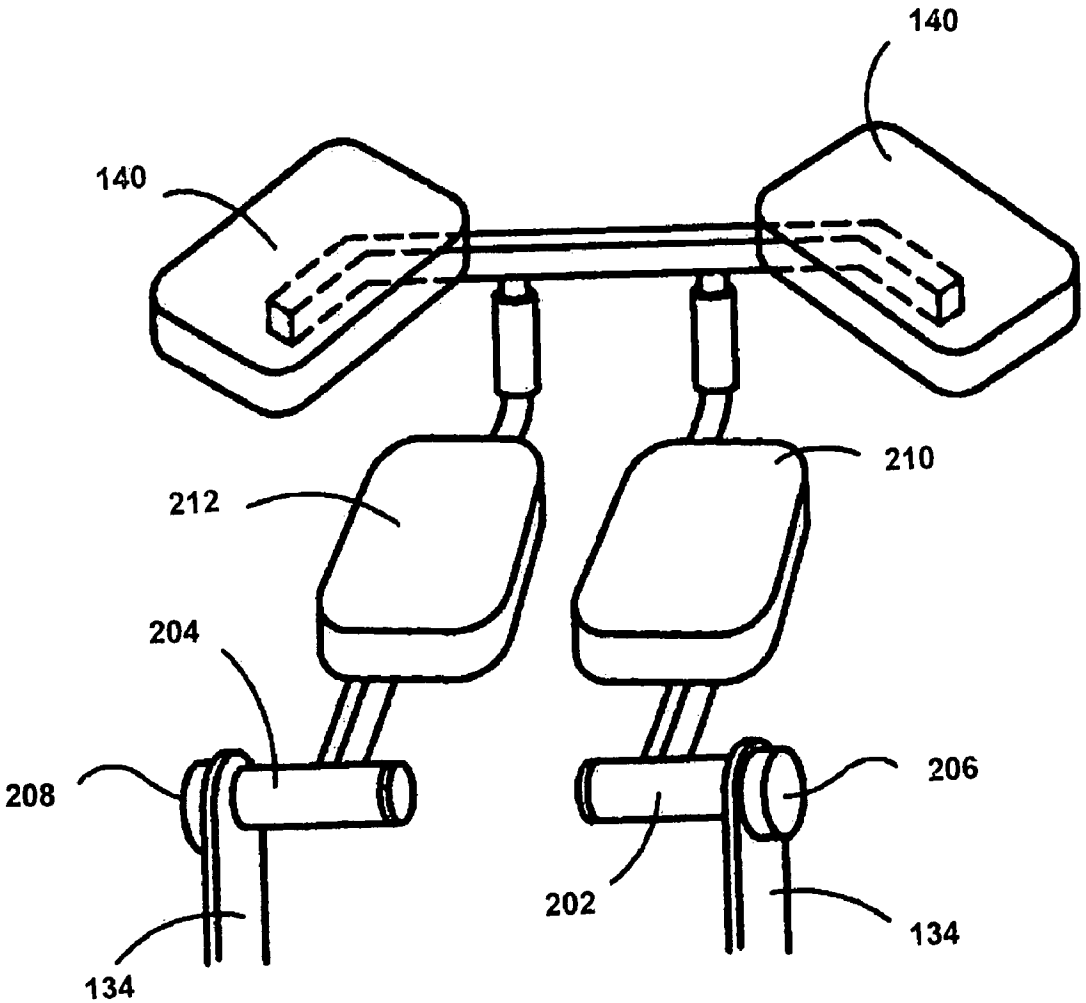
FIG. 2 is a front view of an alternate embodiment of an upper body support of an abdominal exercise apparatus in accordance with the present invention.

In an alternate embodiment, shown in FIG. 2, the cross bar 136 is divided into two sections, right bar section 202 and left bar section 204. Right bar section 202 and left bar section 204 are pivotally attached to elevation bar 144 such that the torque required to rotate right bar section 202 and left bar section 204 can be adjusted, preferably by a tension control members 206 and/or 208 respectively. Tension control members 206 and 208 controls the amount of resistance required to rotate right bar section 202 and left bar section 204 and can be set such that right bar section 202 and left bar section 204 may be locked in any rotational position especially one where arm pad 138 has been rotated towards the track 108. Tension control members 206 and 208 have markings or slots such that each one can be set to the same tension as the other or only one tension control member may be used to control the amount of resistance required to rotate the upper body support 112.

The chest pad 140 is also divided into two sections, right pad 210 and left pad 212. Right pad 210 and left pad 212 are attached to right bar section 202 and left is bar section 204 respectively. In an alternate embodiment, chest pad 140 is a single one piece member.

Figure 3:
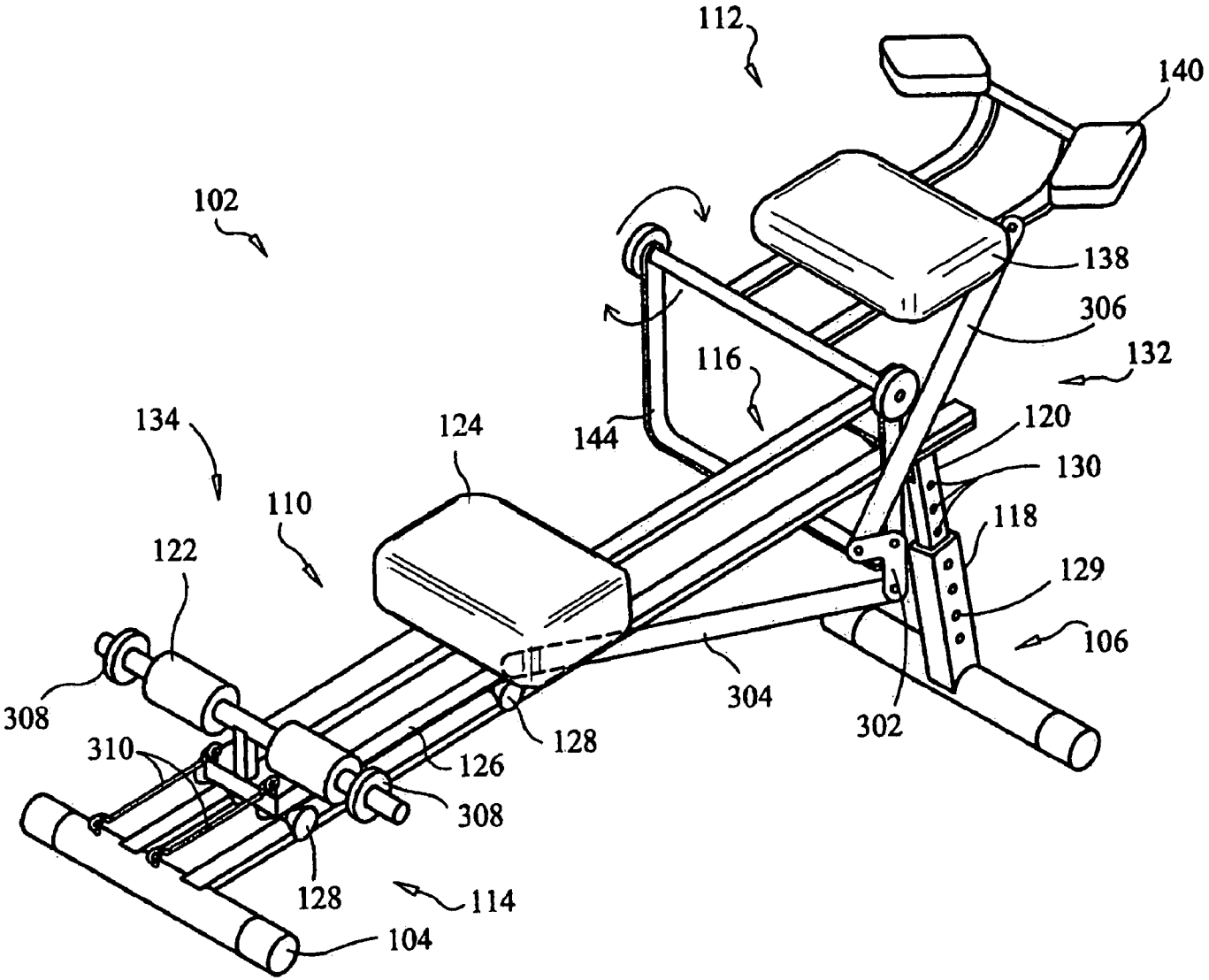
FIG. 3 is a perspective view of an alternate embodiment of an abdominal exercise apparatus in accordance with the present invention.

FIG. 3 shows an alternate embodiment wherein upper body support 112 is pivoted when sled 110 is accelerated towards upper body support 112. Near the point of maximum forward motion of the sled, the user has the option to rock the upper body support forward simulating a sit up or what is known as a "crunch" motion. As shown in FIG. 3, the pivot means is a bell crank with pivot member 302 attached to elevation bar 144, lower arm 304 attached to sled 110, and upper arm 306 attached to upper body support 112. In use, when sled 110 is accelerated towards upper body support, lower arm 304 pushes pivot member 302 causing it to rotate and pull down on upper arm 306, which causes upper body support 112 to rotate. A second function of the pivot means is to help accelerate sled 110 towards upper body support 112 by rotating upper body support 112 towards track 108.

Use of a pivot means, such as the bell crank, forces the user to perform an upper abdominal crunch simultaneously with a controlled and supported reverse crunch. As would be known in the art, other means may be used to pivot upper body support 112 when sled 110 is accelerated towards upper body support 112. For example, other mechanical means similar to a bell crank or a cable and pulley system may be used to pivot upper body support 112 when sled 110 is accelerated towards upper body support 112.

Resistance to sliding the sled is provided by a user's body weight working against gravity, as it is forced upward on the inclined tracks. Resistance can be increased or decreased by raising and lowering the level of incline. Optionally, a resistance member 310 such as a spring, resistance band, or free weights attached to the sled, may be used for additional resistance. Resistance bands are elastic and attached to rear support 104 and sled 110.

Figure 4:
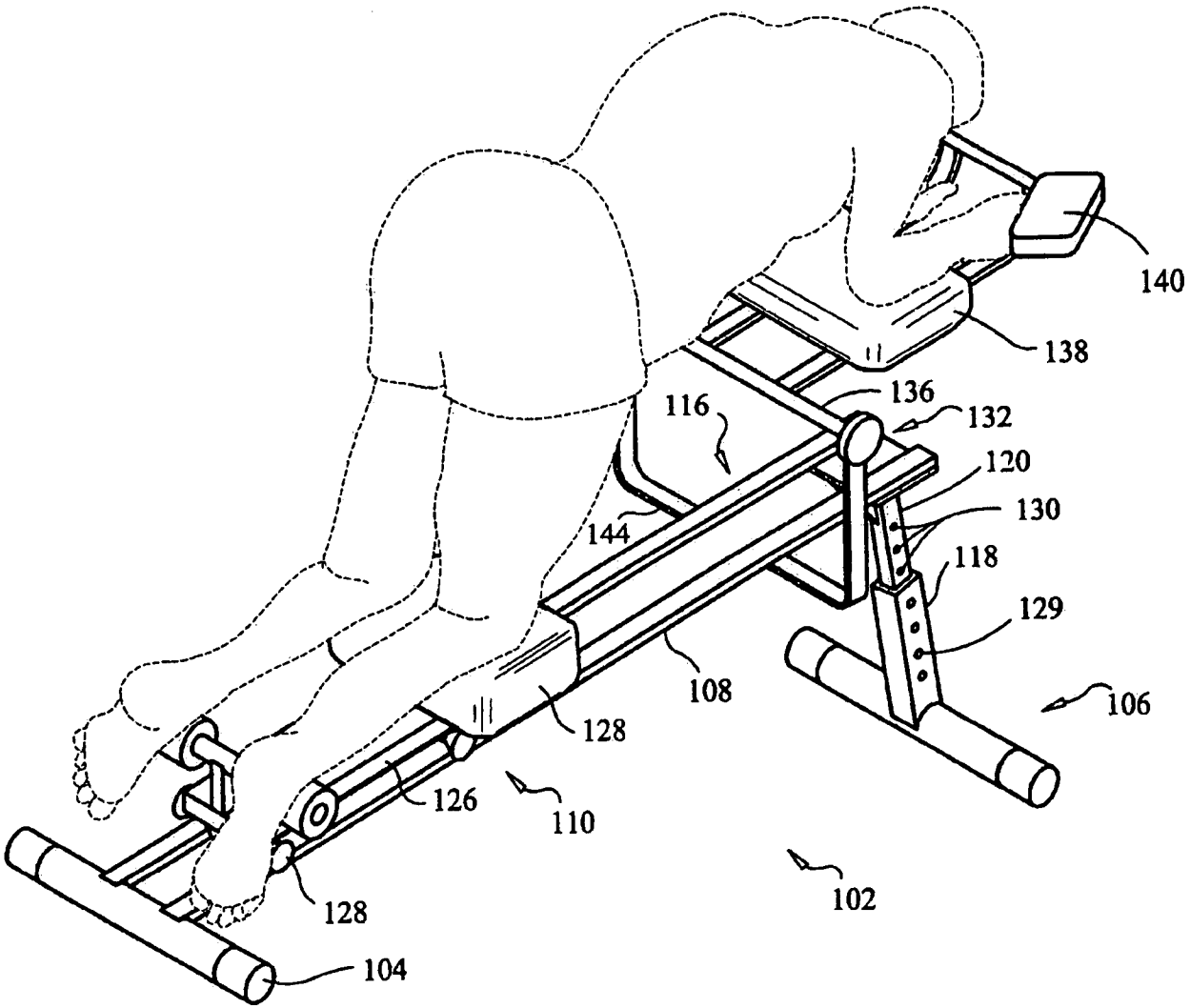
FIG. 4 is a perspective view of the apparatus shown in FIG. 1 in use by a person.

In use, as shown in FIG. 4, the forearms are positioned on upper body support 112 and the shins are positioned onto instep pads 122 on sled 110. Sled 110 is then accelerated towards upper body support 112 by bringing the knees as close as possible to upper body support 112 or the user's chin while keeping forearms positioned on upper body support 112.

By pivoting knee pad 124 up to approximately 45 degrees to the right or left of a plane vertical to the center of sled 110 the force needed to accelerate sled 110 can be supplied by the right or left oblique muscles. In addition, the knees may be brought as high as possible at the peak of the contracted point of both crunches, rendering a tight squeeze in a near fetal position.

To perform an upper body crunch the legs are frozen at a 90 degree angle with respect to knee pad 124 while sled 110 is accelerated towards upper body support 112 and cross bar 136 is pivoted towards track 108. Then, using the upper abdominal muscles, sled 110 is made to travel back and forth along track 108 while the legs and hips remaining locked at a 90 degree angle with respect to knee pad 124.

To perform a reverse crunch, the knees are allowed to freely move while sled 110 is accelerated towards upper body support 112 but cross bar 136 is not allowed to pivot in any direction. Then, using the lower abdominal muscles, sled 110 is made to travel back and forth along track 108 while cross bar 136 is locked in a desired position.

To perform a tandem crunch and exercise both the upper and lower abdominal muscles, the knees are allowed to freely move while sled 110 is accelerated towards upper body support 112 and cross bar 136 is pivoted towards track 108. Then, the upper and lower abdominal muscles are used to force sled 110 to travel back and forth along track 108 while cross bar 136 is pivoted towards track 108.

FIG. 5A shows another preferred embodiment of the abdominal exerciser 500 to work the abdominal and oblique muscle groups and isolate the upper and lower abdominal muscles in a biometrically neutral position. The abdominal exerciser 500 can have a rear support 510, at least one track 520, a front support 530, an upper body support 540 and a sled 600 with or without a knee pad or leg support 550. In a preferred embodiment the track 520 can be an arcuate track 520.

FIG. 5A shows the arcuate track 520 with a front portion 522 and a back portion 524 where the front portion 522 of the arcuate track 520 is attached to the front support 530 and the back portion 524 of the arcuate track 520 is attached to the rear support 510 such that the front portion 522 is at least approximately 6 inches off the ground. Having the front portion 522 elevated at least 6 inches above the ground is beneficial in a number of ways. For instance, this elevation causes the user to oppose the force of gravity by contracting the abdominal muscles when in the crunch position (see FIG. 7B). It also allows the user to exercise in an upright, forward leaning position, much like a bicyclist's pose. This is convenient and familiar to most users and maintains the user's upper body in a fixed, still state allowing the user to read or watch a television show during an exercise.

The track 520 can be curved as shown in FIG. 5A. The curvature can be circular, ellipsoid, parabolic, or any other curved shape that advantageously affects the abdominal and oblique muscles.

Figure 7A:
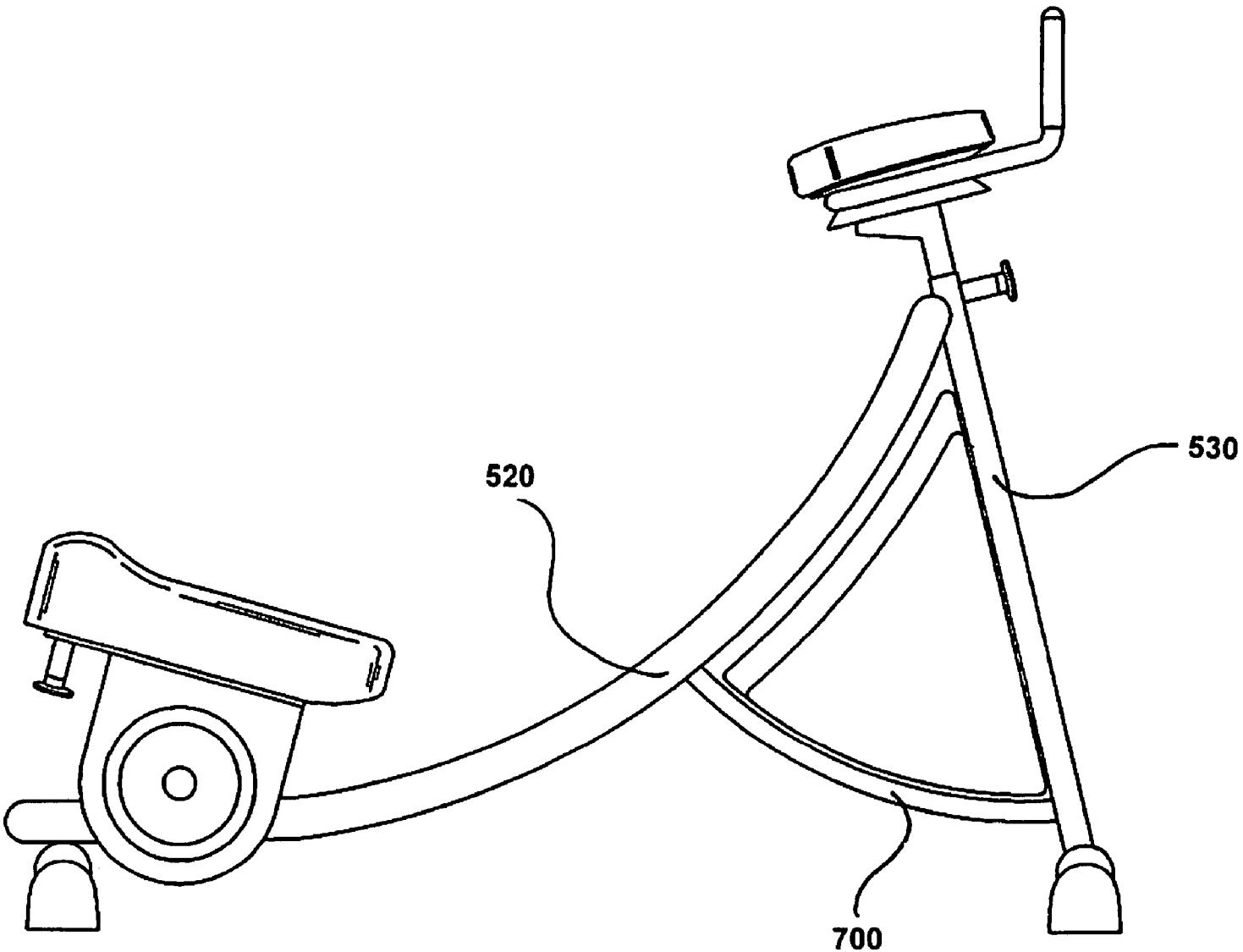
FIG. 7A is a side view of the embodiment of FIG. 6.
Figure 7B:
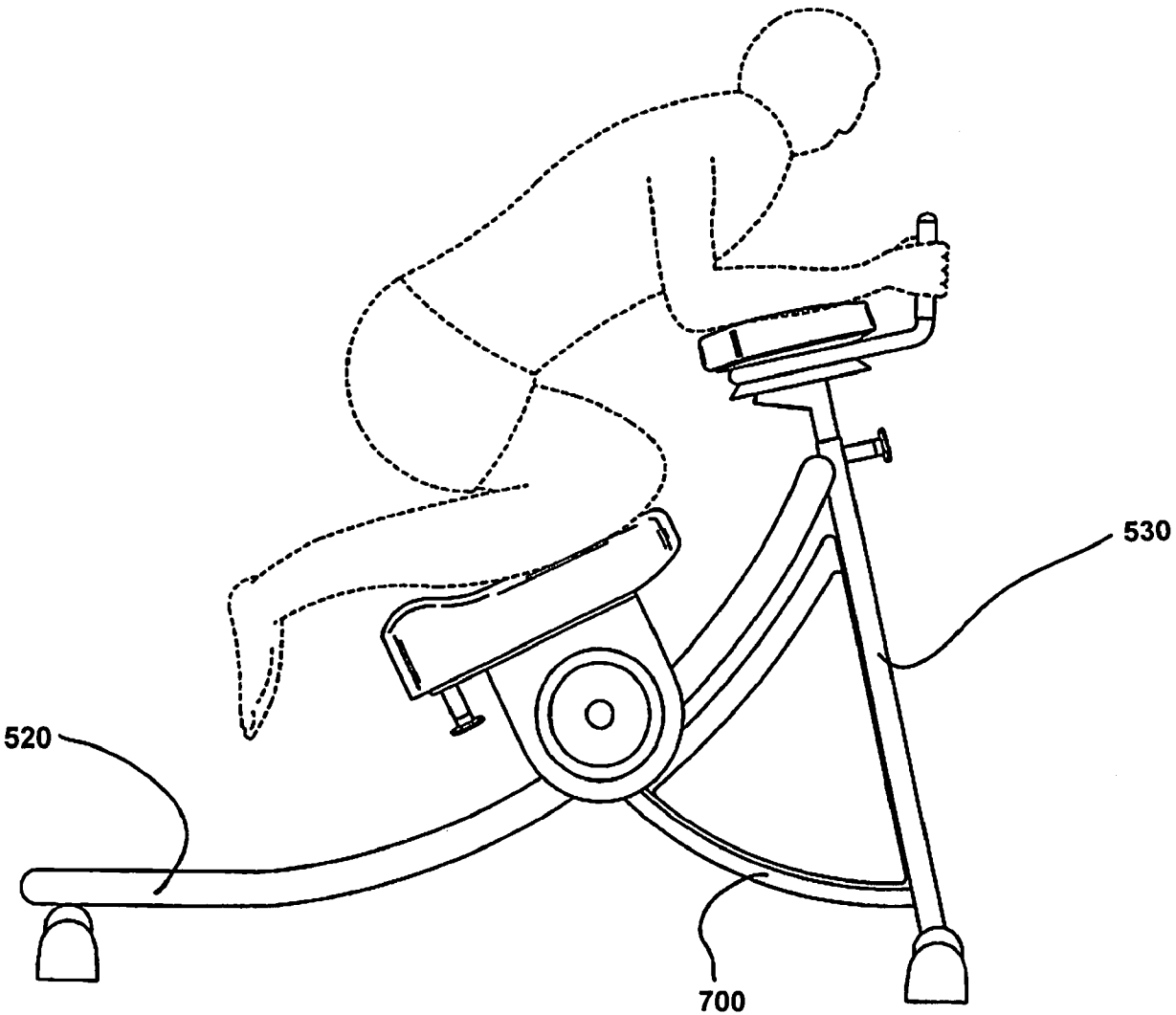
FIG. 7B is a side view of the embodiment of FIG. 6 in use by a person.

The curved nature of the track 520 allows the user to roll his knees towards his chest (see FIG. 7B). It is believed that rolling the knees towards the chest provides for a more effective and safe crunch style abdominal exercise as opposed to the traditional sit up where the person would only pivot at his hips, which could cause injury. Furthermore, the current invention eliminates or minimizes the ability to "cheat" since the entire motion can only be achieved with the abdominal muscles. In the traditional sit-up a person tends to put his hands behind his head pull his head with his arms to facilitate the exercise. This reduces the effectiveness of the exercise as well as creating strain on the neck. In other abdominal exercise devices that also provide for this rolling motion, the user lies on his back, grasps handles then rolls his back into a crunch. However, this again allows for "cheating" as the user could use his arms to facilitate the rolling process.

The convex side of the curved track 520 rests on a support surface such as the floor. The track 520 can be curved both at the front portion 522 and the back portion 524, as shown in FIG. 5A, or the track can be curved at the front portion 522 only, as shown in FIGS. 5B, 6, and 7A-7B. Having the curvature extend to the back end allows the user to exercise his lower back muscles as well.

Figure 8:
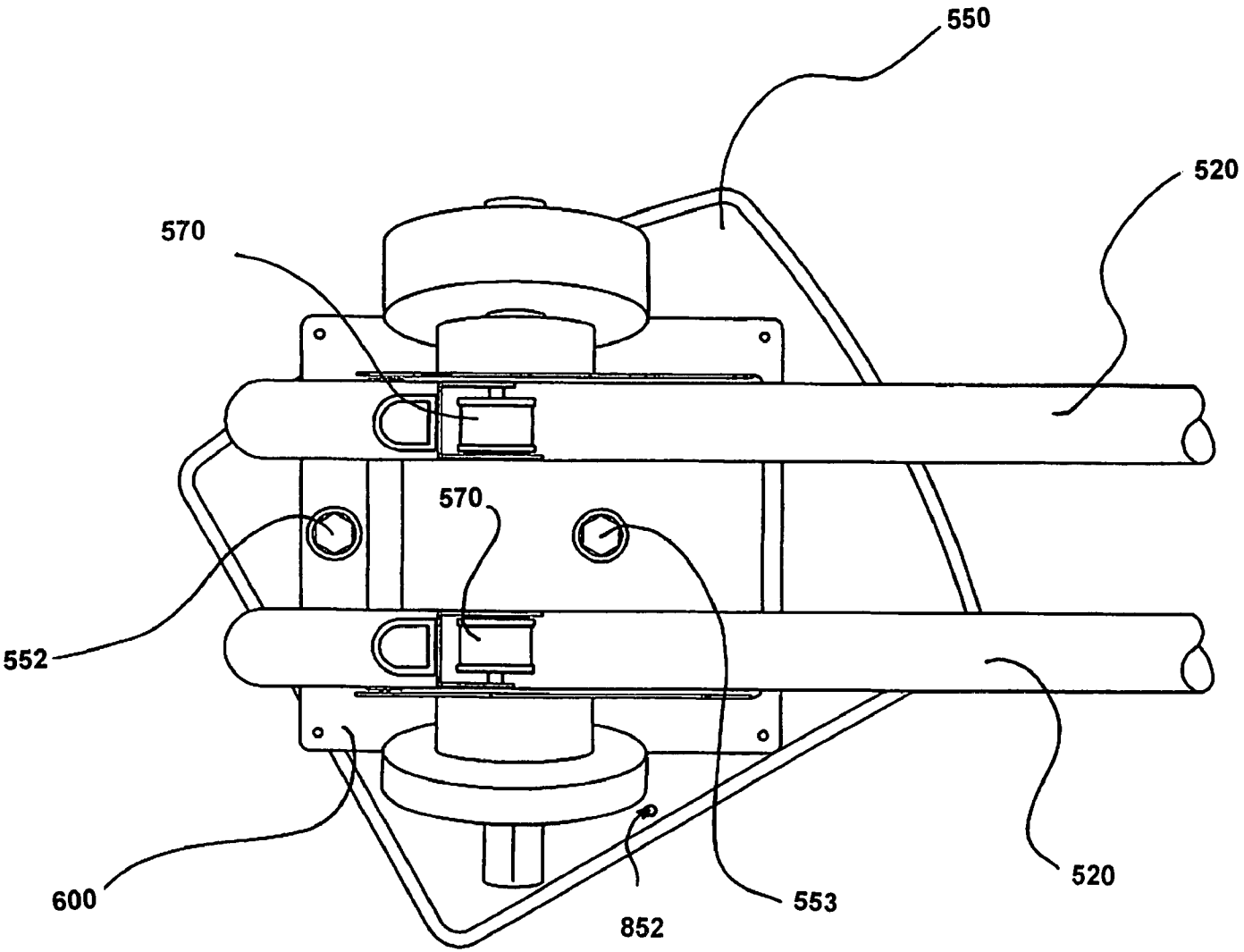
FIG. 8 is a bottom view of the leg support and track.

As shown in FIG. 8, the knee pad or leg support 550 can be slidably mounted on the track 520, and preferably an arcuate track 520. The sliding mechanism 570 can be a rolling element, such as wheels, a plurality of bearings, such as ball bearings or roller bearings, or a gliding mechanism such as a four bar linkage. Alternatively, the knee pad or leg support 550 can be mounted on the sled 600, where the sled 600 can be slidably mounted on the track 520, and preferably an arcuate track, 520 via the aforementioned mechanisms. In a preferred embodiment the leg support 550 can be rotatably mounted to the sled 600. The leg support 550 can rotate up to approximately 45 degrees to the right or left of a plane vertical to the center of the sled 600. In other words, the leg support 550 can rotate up to approximately 45 degrees clockwise or counterclockwise about an axis 553 generally perpendicular to the arcuate track 520.

In a more preferred embodiment the leg support 550 can have a first locking member 552 having a first position and a second position. In the first position the first locking member 552, for example, a lug or pin, disengages the leg support 550, allowing the leg support 550 to freely rotate about an axis 553 that is generally perpendicular to the arcuate track 520. This rotating, pivoting, or swiveling action allows the user to twist his lower body to the left or right while performing an abdominal crunch thereby exercising his left or right oblique abdominal muscles. In the disengaged position the user can alternate exercising his left and right oblique abdominal muscles with each repetition. In the second position the leg support 550 can be locked in a predetermined orientation relative to the sled 600. This stabilizes the leg support 550 to allow the user to concentrate on the exercise rather than focusing on keeping the leg support 550 in a proper orientation. The leg support 550 can be locked at predetermined positions ranging from zero to about 45 degrees to the right or left of a plane vertical to the center of the sled 600. In some versions the locking member is a retractable lug member, pop pin, or pin and yoke configuration.

If the user wants the leg support 550 to be fixed at a particular angle during the exercise, whether the angle is parallel to the track, 45 degrees oblique to the track, or any angle in between, the user simply rotates the leg support 550 to the desired angle and moves the lug or pin 552 into the engaged position by inserting it into an indentation or recess 852 in the engagement surface. Although FIG. 8 shows one indentation or recess 852 there can be a plurality of indentations or recesses 852. As such, the engagement surface of receptor block or yoke comprises a plurality of recesses 852, where each recess 852 is shaped to accept the lug or pin member 552. In the illustrated embodiment, the lug 552 is spring activated, and releasing the lever causes a compression spring (not shown) to force the lug down towards the engagement surface.

Other pin and yoke configurations are equally contemplated, however, within the present invention, including a cog and sprocket arrangement, or alternatively, a threaded pin that requires the user to press the pin into the desired hole, which is tapped with mating threads, and requires twisting the pin into the engaged position in the hole in order to lock the leg support 550 into a desired orientation. The pin and yoke combination could also be replaced with a mechanism comprising engaging teeth, such as a pawl and ratchet wheel, or other such clutch mechanism or one or many clamping configurations such as a tightening strap and tactile contact surface, or the like. With such alternatives, the allowable angular positions of the leg support 550 may be discreet positions (such as with a pin and hole combination) or may be continuous (such as with other common clamping configurations). As a result, the leg support 550 may be freely pivoted about the pivot axis during an exercise, adding to the diversity of abdominal muscle exercises that can be performed. For example, the lug may be removed from the surface and withheld from engaging any of the recesses 852 in the surface either by moving the lug to a plane offset from the recesses 852 or by retaining the lug in the disengaged position so that it is held away from the surface itself during the exercise.

To move the leg support 550 in such a way, the user would release the first locking member 552 from an engaged position to a disengaged position before an exercise to allow the leg support 550 to pivot about a pivot axis, in which the leg support 550 can be locked at any one of a plurality of angles relative to a plane vertical to the center of the sled 600 based on the desired exercise such as in FIG. 8.

The knee pad or leg support 550 can be designed to provide a more supportive and more stylish leg support 550. For example, the knee end can be indented and the ankle end can be raised so as to conform to the contours of the front portion of the average leg.

The upper body support 540 is fixedly mounted in relation to the track 520, and preferably an arcuate track 520. Having the upper body support 540 fixed allows the user to stabilize the upper body and focus the exercise on the abdominal muscles as shown in FIG. 7B. In addition to providing a more effective crunch, having the upper body support 540 fixed facilitates the user to engaging in other cognitive activities such as reading, watching television, or conversing with others. The upper body support 540 can have an elevation bar 542, a cross bar 544, and at least one arm pad or arm support 546. In another embodiment the upper body support 540 can have at least one handle 548 for the user to grasp during the exercise. The upper body support 540 can also have at least one chest pad and at least one head pad.

The upper body support 540 can have a second locking member 549 for selectively adjusting the height of the upper body support 540. In a preferred embodiment the second locking member 549 for selectively adjusting the height of the upper body support 540 can be on the elevation bar 542. The second locking member 549, such as a pop pin or any other locking member described previously, can be disengaged from the front support 530 to allow the upper body support 540 to slide up or down to a desired height, then the locking member can be re-engaged to lock the upper body support 540 in place at the desired height. The elevation bar 542 can be cylindrical in shape to provide a means for rotating the upper body support 540 without having to remove the elevation bar 542 from the front support 530. The elevation bar 542 can further have recesses on opposite sides such that the upper body support 540 can be arranged in at least two different orientations.

As shown in FIG. 5B, the upper body support 540 can be pivotally attached to the front portion 522 of the track 520, and preferably an arcuate track 520. In a preferred embodiment the cross bar 544 of the upper body support 540 can be pivotally attached to the elevation bar 542 and suspended approximately 12 to approximately 48 inches above the arcuate track 520. The embodiments illustrated in FIGS. 5A and 5B show two such mechanisms for providing this adjustability of the upper body support 540, but other telescoping and gear mechanisms are equally contemplated and within the scope of the present invention.

Having the upper body support 540 pivotally attached to the front portion 522 of the arcuate track 520 or the elevation bar 542 allows the handles 548 to pivot from a first position to at least a second position to perform a different type of exercise or isolate a different abdominal muscle group. For example, in a first position the handles 548 can be above the track, in front of the arm pad 546 so that the user can grasp the handles 548 with his knuckles facing forward while resting his upper body on the arm pad 546 (see FIGS. 7A and 7B). In a second position the upper body support 540 can be rotated 180 degrees about an axis protruding up from the front support 530 and then tilted slightly downward by pivoting the upper body support 540 downward about an axis perpendicular to the front support 530 and to the arcuate tracks 520 so that when the user grasps the handles 548 his arms and elbows are tucked in near his rib cage with his knuckles facing a downward direction (see FIG. 5B). Alternatively, the upper body can be placed in a second position by pivoting the handles 548 downward 180 degrees and rotating the upper body support 540 about an axis protruding from the longitudinal direction of the cross bar 544.

To provide for a means for pivoting, the upper body support 540 or cross bar 544 can be detachably coupled to the elevation bar 542 with recesses for receiving a locking member on opposite sides such that the upper body support 540 can be rotated 180 degrees and locked back into the elevation bar 542 in a new orientation. Alternatively, the elevation bar 542 can be cylindrical such that when the locking member is disengaged, the upper body support 540 can be rotated into a new orientation without having to remove the upper body support 540 from the front support 530. In another embodiment the upper body support 540 can be pivotally coupled to the elevation bar 542 via any number of common pivot connections, such as a ball and socket or toothed mechanism. The downward rotation of the upper body support 540 can be accomplished with a variety of hinge-like mechanisms.

The arm pad 546 can be removable so as not to cause interference with the normal use of the exercise device, particularly when the handles 548 of the exercise device are in the lowered position (see FIG. 5B). The elbow portion of the arm pad 546 can be raised to prevent slippage during the exercise.

Figure 6:
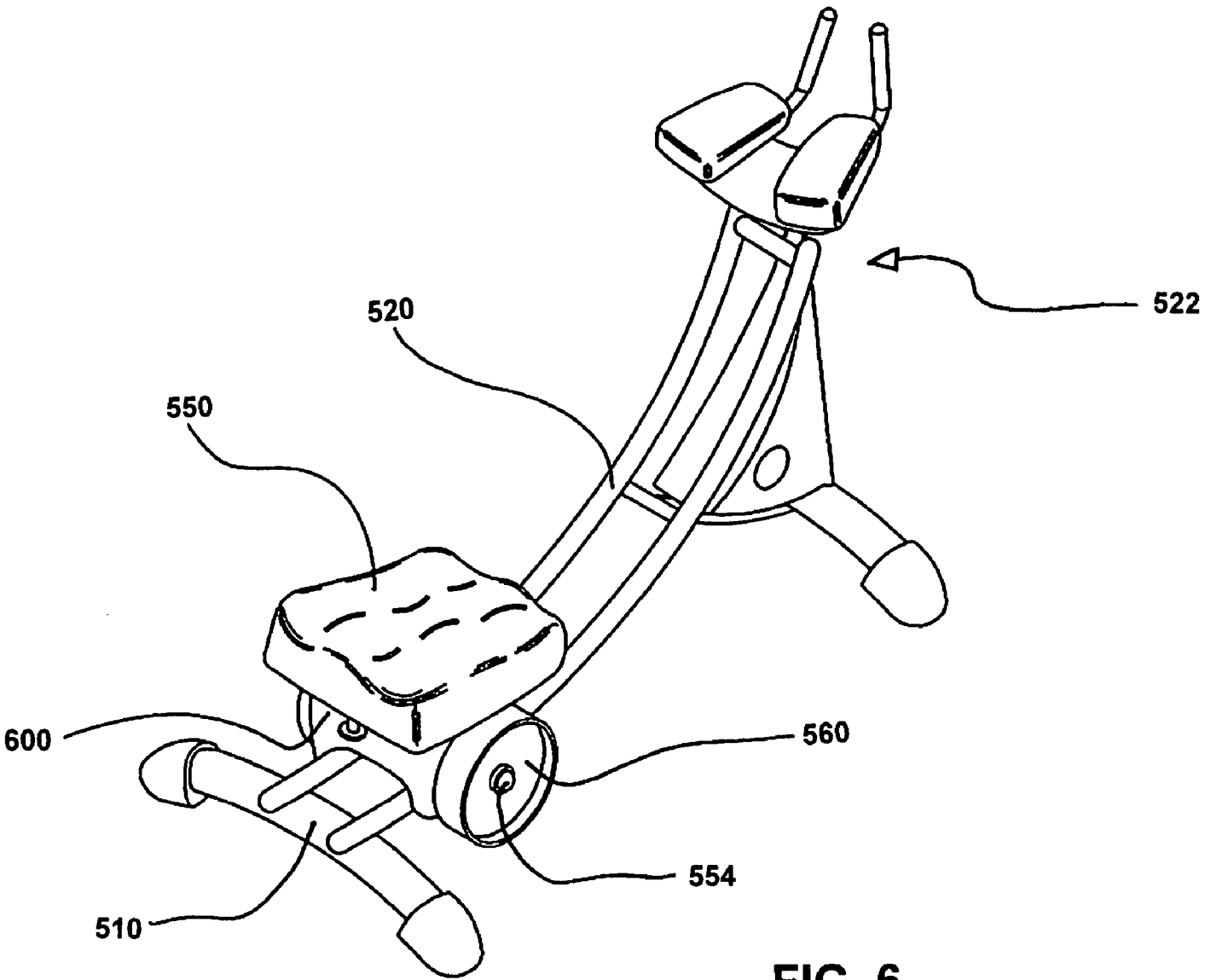
FIG. 6 is a perspective view of another embodiment.

As shown in FIG. 6, the abdominal exercise machine 500 can further comprise a resistive or resistance member 560 to increase the resistance required to move the sled 600 or the leg support 550. The resistance member 560 can be on the leg support 550, the sled 600, or the track 520, and preferably an arcuate track 520. The resistance member 560 can be weights, elastomer members, spring members, viscous members, pneumatic members, or any other means to increase the force required to move the sled 600 along the track. For example, the leg support 550 or sled 600 can have a protrusion 554 to which weights can be added. Alternatively, one end of an elastomer, spring, or pneumatic member can be attached to the protrusion 554 and the other end of the elastomer, spring or pneumatic member can be attached to the front portion 522 or rear support 510. The degree of resistance can be changed by adding more weights, elastomer members, or spring members or by selecting heavier weights, elastomer members with lower elasticity, spring members with higher tension, pneumatic members with higher pressure or any combination thereof.

Both the front support 530 and rear support 510 can each further comprise a third and fourth locking members 532 for selectively adjusting the height of the front portion 522 or back portion 524 of the track 520, and preferably an arcuate track 520, respectively (see FIG. 5A). The third and fourth locking members 532, such as a pop pin or any other locking member described previously, can be disengaged from the front support 530 or rear support 510 to allow the front support 530 or rear support 510 to slide up or down to a desired height, then the third and fourth locking members 532 can be re-engaged to lock the front support 530 or rear support 510 in place at the desired height.

FIGS. 7A and 7B show the abdominal exerciser further comprising a stabilizing bar 700. The stabilizing bar 700 can be pivotally coupled to the track 520, and preferably an arcuate track 520, and detachably coupled to the front support 530. Furthermore, the front support 530 can be pivotally coupled to the arcuate track 520. This provides a means for folding up the exercise machine 500 when not in use. When a user has completed his exercise he can detach the stabilizing bar 700 from the front support 530 and pivot the stabilizing bar 700 up towards the front portion 522 of the arcuate track 520. The stabilizing bar 700 can then be attached to the front portion 522 of the arcuate track 520 or the top portion of the front support 530. In addition, the bottom portion of the front support 530 can be pivoted towards the middle portion of the arcuate track 520 and attached to the middle portion of the arcuate track 520.

In use, as shown in FIGS. 4 and 7B, abdominal crunches can be accomplished by positioning the body on an abdominal exercise machine 500 and using the abdominal muscles to accelerate the sled 600 from the back portion 524 of the track 520, and preferably an arcuate track 520, to the front portion 522 of the track 520 wherein the knees are on the sled 600 and the upper body is on the upper body support 540, and returning the sled 600 to its original or resting position, thereby completing a repetition.

Prior to using the exercise machine 500, the user must set up the machine 500 to suit the user's specifications by adjusting the height of the upper body support 540 by disengaging the second locking member 549, adjusting the upper body support 540 to the desired height, and re-engaging the second locking member 549. In addition, the height of the track 520 can be adjusted by removing a third and fourth locking member, moving the front portion 522, the back portion 524, or both to the desired height, and re-engaging the third and fourth locking member. Also, the user can adjust the positioning of the upper body support 540 by disengaging the second locking member 549, rotating the upper body support 540 180 degrees about an axis protruding longitudinally from the front support 530, then tilting the upper body support 540 downward until the handles 548 are in a desired lowered position, such that the elbows are near the ribcage. From this position the user can return the upper body support 540 to the original position by disengaging the second locking member 549, rotating the upper body support 540 180 degrees, then tilting the upper body support 540 upward until the handles 548 are in the original position such that the elbows are positioned on the arm pad 546 in front of the body. Alternatively, the upper body support 540 can be re-positioned by rotating the handles 548 180 degrees downward, disengaging the second locking member 549, rotating the upper body support 540 about an axis protruding longitudinally from the cross bar 544, and re-engaging the second locking member 549 when the handles 548 are in the desired position.

Once these preliminary adjustments have been made, the user can perform the exercise by placing the user's legs or knees on a leg support 550 slidably mounted to at least one track 520, preferably an arcuate track 520, placing the user's arms on an upper body support 540 fixedly mounted in relation to the track 520, pulling the user's legs and leg support 550 along the track towards the user's chin thereby performing a contraction of the user's abdominal muscles, moving the user's knees and leg support 550 along the track 520 away from the user's chin thereby allowing the user's abdominal muscles to relax and repeating the pulling and moving steps in order to exercise the user's abdominal muscles. In abdominal exercisers 500 where both the front portion 522 and the back portion 524 of the arcuate track 520 is curved an additional lower back exercise can be performed by including the steps of moving the leg support 550 towards the back portion 524 of the arcuate track 520 thereby contracting the user's lower back muscles, then moving the user's knees and leg support 550 along the arcuate track 520 away from the back portion 524 of the arcuate track 520 thereby relaxing the lower back and repeating these steps in order to exercise the lower back muscles.

The intensity of the exercise can be modified by adding a resistive or resistance member 560 to the leg support 550, the sled 600, or the track 520, and preferably an arcuate track 520. The user can select a desired weight, an elastomer member of a desired elasticity, a spring member of a desired tension, a viscous member of a desired viscosity, or a pneumatic member of a desired pressure. If the resistive member 560 is a weight, the user can simply place the weight on a protrusion 554 from the sled 600 or leg support 550. The user can add a single desired weight or multiple weights to achieve the desired weight. If the resistive member 560 is an elastomer member, a spring member, or a pneumatic member, the user can attach these members to the front or the rear support 530, 510 and the sled 600 or leg support 550.

Further steps can include disengaging a leg support 550 by placing a first locking member 552 into a first position and rotating the leg support 550 to one side up to approximately 45 degrees about an axis generally perpendicular to the at least one arcuate track 520, performing a first repetition, rotating the leg support 550 to the other side up to approximately 45 degrees about an axis generally perpendicular to the at least one arcuate track 520, performing a second repetition, and repeating a plurality of repetitions while alternating the rotation of the leg support 550 from one side to another in between each repetition to complete a set of abdominal exercises. This allows the user to alternate exercising one oblique then the other during a set of exercises.

An alternative step can include locking the leg support 550 in a predetermined position by placing the first locking member 552 into a second position such that the leg support 550 is rotated about an axis that is generally perpendicular to the at least one track, up to 45 degrees oblique from a forward direction, completing a plurality of repetitions to complete a set of abdominal exercises, disengaging the first locking member 552 and rotating and locking the leg support 550 in a second predetermined position, up to 45 degrees oblique from the forward direction, and completing a second plurality of repetitions to complete a second set of abdominal exercises. This allows the user to completely exercise one side of the oblique muscles then switch to exercising the other side.

Although the invention has been described with reference to one or more preferred embodiments, the description is not to be construed in a limiting sense. There is modification of the disclosed embodiments, as well as alternative embodiments of this invention, which will be apparent to persons of ordinary skill in the art and various changes in form and detail may be made therein without departing from the spirit and scope of the invention. The invention shall be viewed as limited only by reference to the following claims.

What is claimed is:

1. An abdominal exercise machine to work the abdominal and oblique muscle groups and can isolate the upper and lower abdominal muscles in a biometrically neutral position, the abdominal exercise machine comprising:

a rear support;

at least one arcuate track having a front portion and a back portion wherein the back portion is attached to the rear support;

a front support wherein the front support is attached to the front portion of the at least one track and elevates the front portion of the at least one track at least approximately 6 inches off the ground;

an upper body support attached to the front portion of the at least one track wherein the upper body support comprises an elevation bar attached to the at least one track and at least one handle attached to the elevation bar; and a sled that can slide on the at least one track.

2. The abdominal exercise machine of claim 1 wherein the elevation bar is attached to the at least one track such that the sled can travel past the elevation bar on the track.

3. The abdominal exercise machine of claim 1 wherein the at least one handle is pivotally attached to the elevation bar and suspended approximately 12 to approximately 48 inches above the at least one track.

4. The abdominal exercise machine of claim 1 wherein the upper body support comprises at least one chest support.

5. The abdominal exercise machine of claim 1 wherein the upper body support comprises at least one arm support.

6. The abdominal exercise machine of claim 1 further comprising a knee pad rotatably mounted to the sled wherein the knee pad can rotate up to approximately 45 degrees to the right or left of a plane vertical to the center of the sled.

7. The abdominal exercise machine of claim 1 wherein weights can be added to the sled.

8. A method to exercise the abdominal and oblique muscle groups in a biometrically neutral position, the method comprising the steps of positioning the body on an abdominal exercise machine, the abdominal exercise machine comprising:

a rear support, at least one arcuate track having a front portion and a back portion wherein the back portion is attached to the rear support, a front support wherein the front support is attached to the front portion of the at least one track and elevates the front portion of the at least one track approximately 6 inches off the ground, an upper body support attached to the front portion of the at least one track, and a sled that can slide on the at least one track from the back portion to the front portion of the at least one track; and using the abdominal muscles to accelerate the sled from the rear portion of the at least one track to the front portion of the at least one track wherein the knees or legs rest on the sled and the upper body rests on the upper body support and wherein the upper body support comprises an elevation bar attached to the at least one track and at least one handle attached to the elevation bar.

9. The method of claim 8 wherein the upper body support further comprises at least one arm support.

10. The method of claim 8 wherein the upper body support is pivotally attached to the elevation bar and suspended approximately 12 to 48 inches above the at least one track.

11. An abdominal exercise machine to work the abdominal and oblique muscle groups and can isolate the upper and lower abdominal muscles in a biometrically neutral position, the abdominal exercise machine comprising:

an arcuate track;

a front support wherein the front support is attached a front portion of the track and elevates the front portion of the track off the ground;

an upper body support attached to the front portion of the track; and a sled that can slide on the track.

12. The abdominal exercise machine of claim 11 wherein the upper body support further comprises a second locking member for selectively adjusting the height of the upper body support.

13. The abdominal exercise machine of claim 11 further comprising a leg support rotatably mounted to the sled wherein the leg support can rotate about an axis of rotation generally perpendicular to a top surface of the sled to allow a user to exercise the oblique muscle group.

14. The abdominal exercise machine of claim 13 wherein the leg support further comprises a first locking member having a first position and a second position wherein the first locking member in the first position disengages the leg support allowing the leg support to freely rotate about said axis of rotation; and wherein the first locking member in the second position locks the leg support in a predetermined orientation relative to the sled in order to vary the type of exercise by the user.

15. The abdominal exercise machine of claim 13 wherein a portion of the leg support comprises a plurality of recesses for receiving a portion of the first locking member to lock said leg support in one of a plurality of angles oblique to the path of the sled along the track.

16. The abdominal exercise machine of claim 11 further comprising a resistance member to increase the force required to move the sled, said resistance member selected from the group consisting of a weight, an elastomer member, a spring member, a viscous member, and a pneumatic member.

17. The abdominal exercise machine of claim 11 wherein the upper body support further comprises at least one handle and wherein the upper body support is pivotally attached to the front portion of the at least one track so that the at least one handle can pivot between two or more positions allowing a user to select between different types of exercises.

18. A method to exercise the abdominal and oblique muscle groups in a biometrically neutral position, the method comprising the steps of placing a user's hands on an upper body support fixedly mounted in relation to an arcuate track;

placing at least portions of the user's legs on a leg support slidably mounted to the arcuate track;

pulling the user's knees and leg support along the arcuate track towards the user's chin thereby performing a contraction of the user's abdominal muscles;

moving the user's knees and leg support along the track away from the user's chin thereby allowing the user's abdominal muscles to relax; and repeating the pulling and moving steps in order to exercise the user's abdominal muscles.

19. The method of claim 18 wherein the leg support is mounted to a sliding mechanism selected from a group consisting of a plurality of rolling elements, a plurality of bearings, and a four bar linkage.

20. The method of claim 18 wherein the leg support further comprises a plurality of recesses for receiving a portion of a first locking member and a sled member that houses the first locking member, wherein the first locking member comprises a first position and a second position such that the first locking member in the first position disengages the leg support allowing the leg support to freely rotate about an axis of rotation that is generally perpendicular to a top surface of the sled member and the first locking member in the second position locks the leg support in a predetermined orientation relative to the top surface of the sled member.

21. The method of claim 20 further comprising the steps of disengaging the leg support by placing the first locking member into the first position;

rotating the leg support in a first direction about an axis of rotation generally perpendicular to a top surface of the sled member;

performing a first abdominal and oblique crunch;

rotating the leg support in the opposite direction about the axis of rotation;

performing a second abdominal and oblique crunch; and repeating the foregoing rotations and crunches to complete a set of abdominal exercises.

22. The method of claim 20 further comprising the step of locking the leg support in a predetermined angle oblique from a forward direction;

completing a plurality of repetitions to complete a set of exercises of both the abdominal and oblique muscle groups.

23. The method of claim 18 further comprising the step of adding a resistive force to the leg support by selecting from a group of resistive members consisting of an elastomer member, a spring member, a viscous member, a pneumatic member, and a weight.

24. The method of claim 18 further comprising the steps of disengaging a second locking member attached to the upper body support;

adjusting the height of the upper body support; and re-engaging the second locking member to the upper body support to adjust the height of the upper body support to be suitable for the height of the user so that the user's upper body is placed in a biometrically neutral position during the exercise.

25. The method of claim 18 further comprising the step of adjusting the positioning of at least one handle attached to the upper body support by rotating around and tilting down the upper body support until the handles are in a desired lowered position such that the elbows are near the ribcage for a different type of exercise.

26. The method of claim 18 further comprising the steps of adjusting the positioning of at least one handle attached to the upper body support by rotating the at least one handle 180 degrees downward; and rotating the upper body support about an axis of rotation generally perpendicular to the front support and the arcuate track.

27. A method to exercise the abdominal and oblique muscle groups in a biometrically neutral position, the method comprising the steps of placing a user's hands on an upper body support fixedly mounted in relation to a track;

placing at least portions of the user's legs on a leg support slidably mounted to the track;

pulling the user's knees and leg support along the track towards the user's chin thereby performing a contraction of the user's abdominal muscles;

moving the user's knees and leg support along the track away from the user's chin thereby allowing the user's abdominal muscles to relax; and repeating the pulling and moving steps in order to exercise the user's abdominal muscles.

28. The method of claim 27 wherein the leg support is mounted to a sliding mechanism selected from a group consisting of a plurality of rolling elements, a plurality of bearings, and a four bar linkage.

29. The method of claim 27 wherein the leg support further comprises a plurality of recesses for receiving a portion of a first locking member and a sled member that houses the first locking member, wherein the first locking member comprises a first position and a second position such that the first locking member in the first position disengages the leg support allowing the leg support to freely rotate about an axis of rotation that is generally perpendicular to a top surface of the sled member and the first locking member in the second position locks the leg support in a predetermined orientation relative to the top surface of the sled member.

30. The method of claim 29 further comprising the steps of disengaging the leg support by placing the first locking member into the first position;

rotating the leg support in a first direction about an axis of rotation generally perpendicular to a top surface of the sled member;

performing a first abdominal and oblique crunch;

rotating the leg support in the opposite direction about the axis of rotation;

performing a second abdominal and oblique crunch; and repeating the foregoing rotations and crunches to complete a set of abdominal exercises.

31. The method of claim 29 further comprising the step of locking the leg support in a predetermined angle oblique from a forward direction;

completing a plurality of repetitions to complete a set of exercises of both the abdominal and oblique muscle groups.

32. The method of claim 27 further comprising the step of adding a resistive force to the leg support by selecting from a group of resistive members consisting of an elastomer member, a spring member, a viscous member, a pneumatic member, and a weight.

33. The method of claim 27 further comprising the step of disengaging a second locking member attached to the upper body support;

adjusting the height of the upper body support; and re-engaging the second locking member to the upper body support to adjust the height of the upper body support to be suitable for the height of the user so that the user's upper body is placed in a biometrically neutral position during the exercise.

34. The method of claim 27 further comprising the step of adjusting the positioning of at least one handle attached to the upper body support by rotating around and tilting down the upper body support until the handles are in a desired lowered position such that the elbows are near the ribcage for a different type of exercise.

35. The method of claim 27 further comprising the steps of adjusting the positioning of at least one handle attached to the upper body support by rotating the at least one handle 180 degrees downward; and rotating the upper body support about an axis of rotation generally perpendicular to the front support and the arcuate track.

36. An abdominal exercise machine to work the abdominal and oblique muscle groups and can isolate the upper and lower abdominal muscles in a biometrically neutral position, the abdominal exercise machine comprising:

an arcuate track;

an upper body support fixedly mounted on the arcuate track for holding a user's upper body still during the exercise; and a leg support slidably mounted to the arcuate track for supporting the user's knees or lower legs as the user pulls his knees along a path defined by the arcuate track towards his chin.

37. The abdominal exercise machine of claim 36 wherein the upper body support further comprises an elevation bar, said elevation bar comprising a second locking member for selectively adjusting the height of the upper body support allowing the user to adjust the upper body support so that the user's upper body is placed in a biometrically neutral position during the exercise.

38. The abdominal exercise machine of claim 36 wherein the upper body support further comprises at least one handle and wherein the upper body support is pivotally attached to the front portion of the arcuate track so that the at least one handle can pivot to at least a second position for a different type of exercise.

39. The abdominal exercise machine of claim 36 wherein the leg support further comprises a first locking member having a first position and a second position wherein the first locking member in the first position disengages the leg support allowing the leg support to freely rotate about an axis that is generally perpendicular to the arcuate track; and the first locking member in the second position locks the leg support in a predetermined orientation relative to the sled.

40. The abdominal exercise machine of claim 36 wherein the leg support further comprises a protrusion for holding at least one weight.

41. The abdominal exercise machine of claim 36 further comprising a resistance member selected from the group consisting of an elastomer member, a spring member, a viscous member, and a pneumatic member to increase the force required to move the sled.

* * * * *